US006177869B1

(12) United States Patent
McDaid

(10) Patent No.: US 6,177,869 B1
(45) Date of Patent: Jan. 23, 2001

(54) REMOVABLE SECURITY DEVICE FOR PORTABLE ARTICLES

(75) Inventor: Cornelius McDaid, Dorchester, MA (US)

(73) Assignee: Kryptonite Corporation, Canton, MA (US)

( * ) Notice: Under 35 U.S.C. 154(b), the term of this patent shall be extended for 0 days.

(21) Appl. No.: 09/400,593

(22) Filed: Sep. 21, 1999

(51) Int. Cl.[7] ..... G08B 13/14

(52) U.S. Cl. ..... 340/568.1; 340/571; 340/572.8; 340/542; 340/546; 340/548; 340/545.5

(58) Field of Search ..... 340/568.1, 568.5, 340/568.6, 568.7, 568.8, 571, 573.1, 572.9, 572.1, 572.8, 540, 542, 546, 548, 545.5, 545.6

(56) References Cited

U.S. PATENT DOCUMENTS

D. 388,310 12/1997 Ling .
5,870,023 * 2/1999 Jackson ..... 340/568
5,912,623 * 6/1999 Pierson ..... 340/573.4
5,960,651 * 10/1999 Tanisawa ..... 340/571
5,973,569 * 10/1999 French et al. ..... 340/568.6
5,999,799 * 12/1999 Hu et al. ..... 455/67.7
6,069,563 * 5/2000 Kadner et al. ..... 340/571
6,118,380 * 9/2000 Gannon ..... 340/573.4

* cited by examiner

*Primary Examiner*—Nina Tong
(74) *Attorney, Agent, or Firm*—Morse, Altman & Martin

(57) ABSTRACT

A removable security device for a portable article that includes an alarm housing with an audible electronic alarm circuit and a locking mechanism, a receiver that attaches to the portable article. The alarm housing has a pair of opposed rails that define a channel and the receiver has a pair of opposed flanges that mate with and that slide into the channel. A lock bolt, operated by the locking mechanism, extends from the alarm housing into a shaped depression in the receiver to secure the alarm housing to the receiver, and retracts from the depression to permit removal of the alarm housing from the receiver. The audible alarm is triggered by a motion detector or by cutting an attached cable.

14 Claims, 3 Drawing Sheets

REMOVABLE SECURITY DEVICE FOR PORTABLE ARTICLES

BACKGROUND OF THE INVENTION

1. Field of the Invention

The present invention relates to security devices for portable articles, more particularly, to a removable security device for portable computers and the like that includes a cable for securing the device to a stationary object and an audible alarm.

2. The Prior Art

As portable computers and other expensive electronic equipment have become more common, theft of such equipment has increased. There are a number of different types of devices on the market to deter such thefts. Most of these devices are either bulky, so that they are not particularly portable, or they rely on the small rectangular slot that is being manufactured into portable computers. The problem with relying on this slot is that the attachment is not particularly robust. Although it would damage the portable equipment, it would be a relatively simple matter to pry the lock out of the slot. Thus, there is a need for a more robust security device that is also portable enough to accompany the portable equipment without undo effort.

SUMMARY OF THE INVENTION

An object of the present invention is to provide a security device for portable electronic equipment that is portable and relatively robust.

Another object is to provide a security device for portable electronic equipment that can be removed from the portable article when not in use.

A further object is to provide a security device for portable electronic equipment that has a audible alarm and alternate methods of triggering the alarm.

The removable security device of the present invention is for use on a portable article, such as a portable computer, and comprises (a) an alarm housing with an audible electronic alarm circuit and a locking mechanism; (b) a receiver for attachment to the portable article; (c) a pair of opposed rails on the bottom surface of the alarm housing, the rails defining a channel approximately parallel to the bottom surface and having an ingress; (d) a pair of opposed flanges on the receiver shaped to mate relatively snugly with the channel and to slide into the channel ingress; (e) a stop means for preventing the flanges from sliding beyond effective engagement with the channel, the alarm housing considered to be installed on the receiver when the flanges are slid into the channel and stopped by the stop means; and (f) a lock bolt operated by the locking mechanism to extend from the alarm housing bottom surface into a shaped depression in the receiver when the alarm housing is installed on the receiver in order to secure the alarm housing to the receiver, and to retract from the shaped depression into the alarm housing to permit removal of the alarm housing from the receiver.

A pair of opposed rails define a channel approximately parallel to the surface of the alarm housing. In one embodiment, the rails are elongated and extend for the entire length of the channel. In another embodiment, each rail is a linear set of L-shaped protrusions. At least one end of the channel is open at an ingress.

The receiver, attached to the portable article, provides a pair of opposed flanges that slide into the channel via the ingress. A stop prevents the flanges from sliding beyond effective engagement with the channel. The receiver is either manufactured integrally with the portable article or attached to a pre-existing portable article permanently or removably. If removably attached, the attachment is not accessible when the alarm housing is installed on the receiver.

The alarm housing has a locking mechanism, operated by a key or combination, that operates a lock bolt that extends from the alarm housing into a shaped depression in the receiver. Preferably, the lock bolt is biased out of the alarm housing and snaps into the depression when the alarm housing is installed on the receiver. The locking mechanism is used to retract the lock bolt out of the depression and into the alarm housing so the alarm housing can be removed from the receiver.

A cable is housed within the alarm housing and is retractable. A cable pushbutton operates the retraction mechanism when the locking mechanism is not engaged. The free end of the cable has a plug that mates with a socket in the alarm housing. The socket is operated by a socket pushbutton that releases the cable when the locking mechanism is not engaged. Alternatively, the present invention uses an independent cable that has a plug that fits into a socket in the alarm housing. It is also contemplated that both configurations can be accommodated in by one alarm housing.

The alarm circuit includes an audible alarm that is triggered by one or more of a number of optional means. One means is through cutting the cable after the alarm has been armed. Another is by an optional motion detector. The battery compartment has a hatch to which access is denied when the alarm housing is installed on the receiver. Optionally, the locking mechanism secures the hatch.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION

Figure 3:
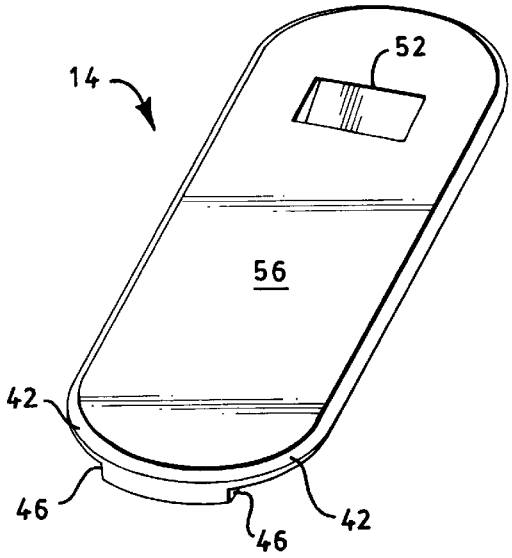
FIG. 3 is a top perspective view of the receiver of the present invention.
Figure 4:
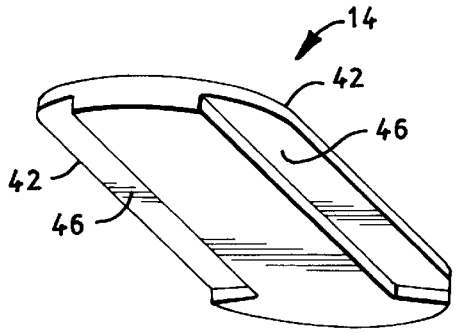
FIG. 4 is a bottom perspective view of the receiver of FIG. 3.

The removable security device 10 of the present invention is for use on a portable article 8, such as a portable computer. There are two main components to the device 10, a alarm housing 12, shown in FIGS. 1 and 2, and a receiver 14, shown in FIGS. 3 and 4. The alarm housing 12 is removably securable to the receiver 14 by a channel/flange arrangement.

Figure 2:
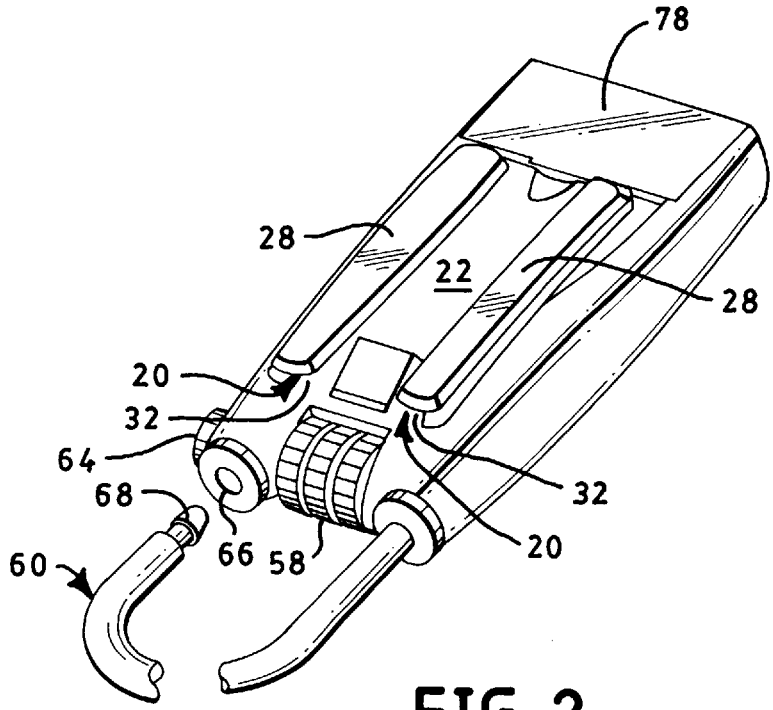
FIG. 2 is a bottom perspective view of the alarm housing of FIG. 1.
Figure 5:
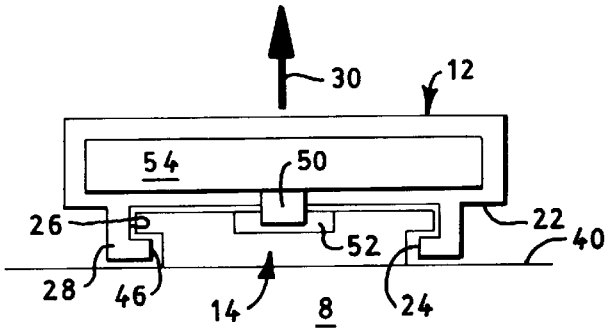
FIG. 5 is a cross-sectional view of the present invention with the alarm housing installed on the receiver.
Figure 6:
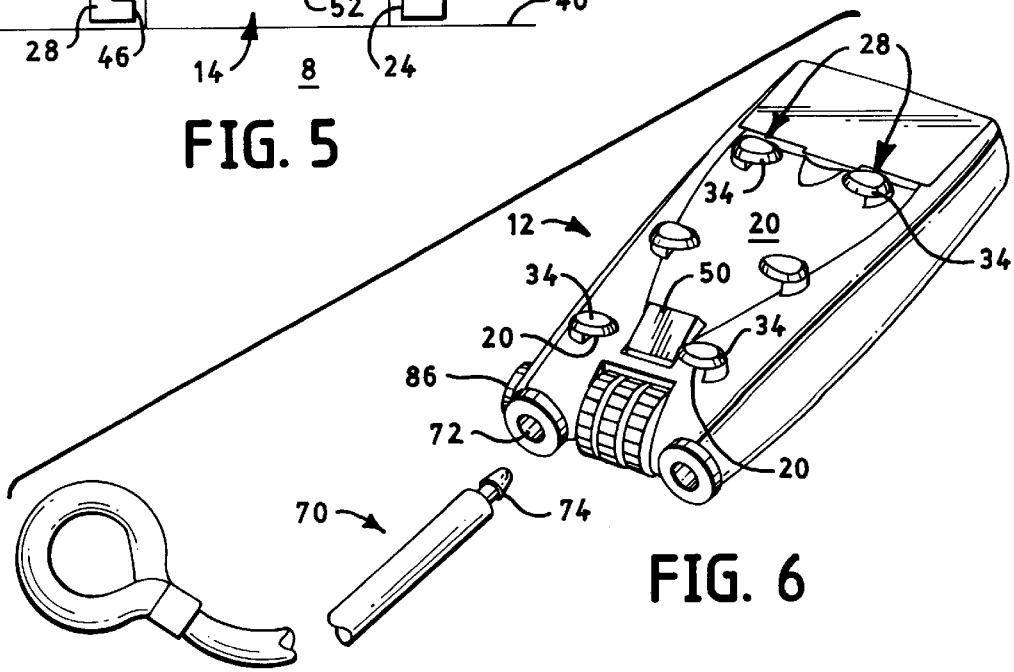
FIG. 6 is a perspective view of the alarm housing showing alternate configurations of several components.

The channel 20 is defined by a pair of opposed rails 28 protruding from the bottom surface 22 of the alarm housing 12. In the embodiment of FIG. 2, the rails 28 are elongated and extend for the entire length of the channel 20. In the embodiment of FIG. 6, each rail 28 is a linear set of L-shaped protrusions 34. The channel 20 is approximately parallel to the surface 22, and has a cross-section that can be any shape as long as the width of some part of the inner surface 26 is greater than the width of the opening 24. Examples include rectangular, as in FIG. 5, trapezoidal, as in a dovetail, and mushroom. The shape must be such that the rails 28, 34 are thick enough so as not to bend outwardly significantly when subjected to a relatively large amount of pulling force, as at 30. At least one end of the channel 20 is open at an ingress 32.

The receiver 14 is located permanently on the surface 40 of the portable article 8, and provides a pair of opposed flanges 42 spaced from and approximately parallel to the surface 40 of the portable article 8, so that there is a narrow groove 46 between the flange 42 and article surface 40. The present invention contemplates that the receiver 14 can be either manufactured integrally with the portable article 8 or retrofitted to a pre-existing portable article 8. The retrofit version of the receiver 14 is preferably permanently fastened to the portable article 8 by whatever manner is appropriate, such as by a permanent adhesive or non-removable fasteners. Alternatively, the receiver 14 is removably attached to the portable article 8 by, for example, screws. The screws can be removed when the alarm housing 12 is not installed on the receiver 14, but are not accessible when the alarm housing 12 is installed on the receiver 14.

The alarm housing 12 is installed on the receiver 14 by sliding the channels 20 onto the receiver flanges 42. Preferably, the dimensions of the channels 20 and flanges 42 are such that they fit together easily, but relatively snugly. A snug fit reduces unwanted play between the alarm housing 12 and receiver 14. In one embodiment, all channels 20 and flanges 42 have the same dimensions so that the alarm housing 12 may be installed in either direction. Optionally, the channels 20 and flanges 42 have different dimensions so that the alarm housing 12 can only be installed in one direction. Alternatively, the channels 20 and flanges 42 are skewed slightly so that the alarm housing 12 can only be installed in one direction.

Figure 1:
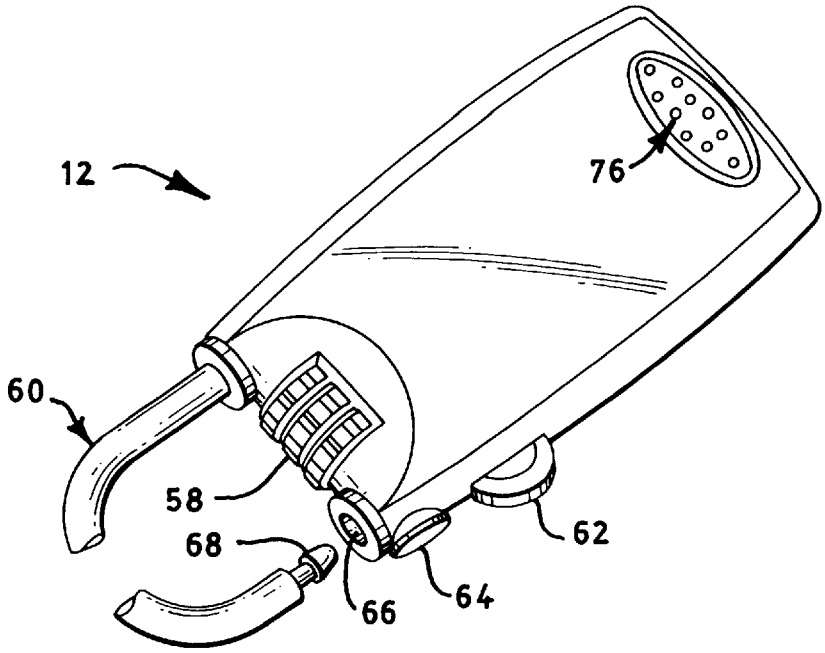
FIG. 1 is a top perspective view of the alarm housing of the present invention.

The alarm housing 12 houses the locking, securing, and alarm mechanisms of the device 10. The locking mechanism 54 provides the security for the device 10. The locking mechanism 54 may be operated by a key or by a combination 58, as shown in FIGS. 1 and 2. Various appropriate locking mechanisms are well-known in the art and all are contemplated for use by the present invention.

The alarm housing 12 is secured to the receiver 14 by a lock bolt 50 that extends from the alarm housing 12 between the channels 20 into a shaped depression 52 in the receiver 14. There are two basic configurations for the bolt 50. In one configuration, the bolt 50 is both extended and retracted by the locking mechanism 54. In this configuration, the alarm housing 12 is installed on the receiver 14 with the bolt 50 retracted into the alarm housing 12, and then the locking mechanism 54 is operated to extend the bolt 50 into the depression 52. To remove the alarm housing 12, the locking mechanism 54 is operated to retract the bolt 50 from the depression 52 and the alarm housing 12 is removed from the receiver 14.

In the second configuration the bolt 50 has a curved leading edge and is biased out of the alarm housing 12, typically by a spring that is part of the locking mechanism 54. As the alarm housing 12 is installed on the receiver 14, the bolt 50 is pushed back into the alarm housing 12 as it passes over the upper surface 56 of the receiver 14. Then, when the bolt 50 passes over the depression 52, the biasing mechanism causes the bolt 50 to snap into the depression 52. As in the first configuration, the alarm housing 12 is removed by operating the locking mechanism 54 to retract the bolt 50 from the depression 52.

There are several different contemplated configurations for stopping the alarm housing 12 from sliding beyond effective engagement with the receiver 14, effective engagement meaning that the overlap between the channel 20 and flanges 42 is enough to prevent removal of the alarm housing 12 from the receiver 14. In the first, shown in FIG. 4, the flanges 42 do not extend the full length of the receiver 14. Thus, the channels 20 stop when they hit the ends 44 of the flanges 42. In the second configuration, the channels 42 are terminated by a perpendicular barrier. Thus, the channels 20 stop when the barrier reaches the receiver 14. In the third, the channels 20 and flanges 42 are skewed slightly from each other so that alarm housing 12 is stopped when both channels 20 contact both flanges 42. The fourth configuration makes use of the bolt 50 that is biased out of the alarm housing 12. As the alarm housing 12 is installed on the receiver 14, the bolt 50 snaps into the depression 52, preventing the alarm housing 12 from moving farther onto the receiver 14. With this configuration, the leading edge of the bolt 50 cannot be curved where it contacts the edge of the depression 52, otherwise the bolt 50 could be forced back up into the alarm housing 12 by continuing to push the alarm housing onto the receiver 14.

The alarm housing 12 includes a cable 60, which has several contemplated configurations. In the first configuration, shown in FIG. 1, the cable 60 is retractable, and is permanently attached by one end inside the alarm housing 12. Depressing a cable pushbutton 62, a component of the locking mechanism 54, releases the cable 60 so that it can be pulled from the alarm housing 12, and when the cable pushbutton 62 is released, a brake holds the cable 60 to the length pulled from the alarm housing 12. Depressing the cable pushbutton 62 when the cable 60 is extended from the alarm housing 12 causes the internal spring mechanism to pull the cable 60 back into the alarm housing 12.

After being pulled from the alarm housing 12, the cable 60 is looped around the stationary object to which the article 8 is being secured. A plug 68 at the end of the cable 60 is then plugged into a socket 66 in the alarm housing 12, where it is latched. The socket 66 is operated by a socket pushbutton 64, a component of the locking mechanism 54. When the locking mechanism 54 is not engaged, depressing the socket pushbutton 64 releases the cable plug 68 from the socket 66. When the locking mechanism 54 is engaged, the socket pushbutton 64 will not operate, and when the cable plug 68 is latched into the socket 66, the cable pushbutton 62 will not operate. Using two pushbuttons provides a safety feature. If is single pushbutton were used, releasing the cable plug 68 from the socket 66 would also cause the cable 60 to be retracted into the alarm housing. Since the cable 60 is bent at least into a semicircle, releasing the cable 60 would cause the cable plug 60 to flail around as it is being retracted, a potential safety concern.

The second configuration, shown in FIG. 6, uses an independent cable 70 with a plug 74 that fits into a socket 72. In this configuration, a single button 86 provides enough functionality. It is also contemplated that the alarm housing 12 is designed to accommodate both cable configurations alternatively.

Figure 7:
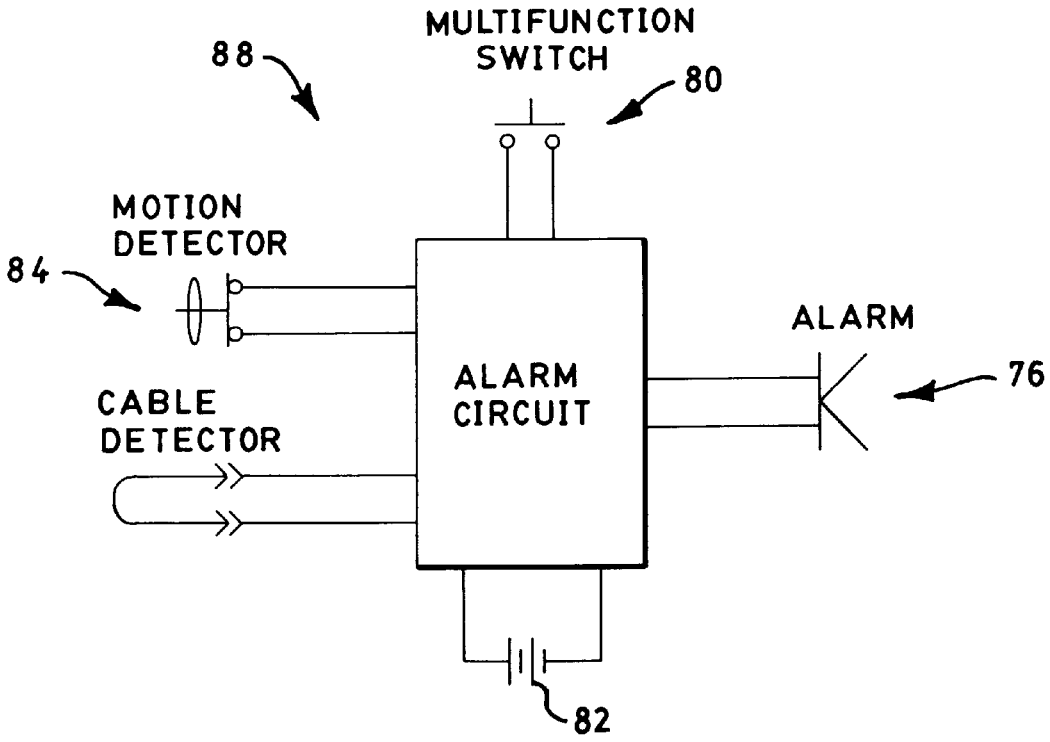
FIG. 7 is a block diagram of the alarm circuitry.
Figure 8:
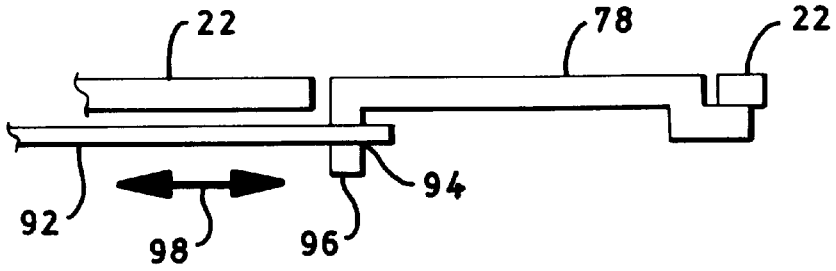
FIG. 8 is a cross-sectional view of the security mechanism for the battery hatch.

The alarm housing 12 includes an audible alarm 76 that is triggered by one or more of a number of optional means. A block diagram of the alarm circuit 88 is shown in FIG. 7. Since alarm circuit 88 is electric, it needs a battery 82 for power. The battery 82 is housed in a compartment covered by a hatch 78 on the under side of the alarm housing 12. The hatch 78 is placed so that when the alarm housing 12 is installed on the receiver 14, the hatch 78 cannot be removed, denying access to the battery 82. Optionally, as an added security precaution, the cable pushbutton 62 or locking mechanism 54 provides a means for securing the hatch 78. In one mechanism, shown in FIG. 8, a rod 92 operated by the cable pushbutton 62 acts as a deadbolt by fitting in an aperture 94 in a flange 96 on the hatch 78. When the cable pushbutton 62 is depressed, the rod 92 is retracted from the aperture 94, as at 98, allowing the hatch 78 to be removed.

One method for triggering the alarm 76 is by cutting the cable 60, 70. Preferably, the cable 60 of FIG. 1 completes an arming circuit when it is plugged into the socket 66. If the cable 60 is cut, the circuit is broken, and the alarm 76 sounds. The independent cable 70 of FIG. 6 could include a wire loop that extends the length of the cable 70 and has both ends at the plug 74. When the plug 74 is inserted in the socket 72, the arming circuit is completed, and if the cable 70 is cut, the circuit is broken, causing the alarm 76 to sound.

Another method of alarm triggering is by means of a motion detector 84, typically a mercury switch or a spring switch that breaks a circuit when moved. The motion detector 84 may be armed by plugging the cable 60, 70 into the socket 66, 72. The alarm 76 triggers when the alarm housing 12 (and, consequently, the portable article 8 to which it is attached) is moved. Typically, there will be a delay of some seconds before the alarm 76 is armed so that the motion detector 84 will not set off the alarm 76 prematurely.

Optionally, the motion detector 84 can be set to different sensitivities by means of a sensitivity button 80 accessible from the outside of the alarm housing 12. The button 80 may toggle through several levels of sensitivity, including the ability to completely disable the motion detector 84. Optionally, the button 80 is located between the channels 20 on the under side of the alarm housing 12 so that it is not accessible when the alarm housing 12 is installed on the receiver 14.

Optionally, the alarm housing 12 includes a means to control which triggering mechanism is active. In one, the motion alarm sensitivity button incorporates control functions as additional toggles of the button 80. In another, as separate switch controls which triggering mechanism is active.

Thus it has been shown and described a security device for portable articles which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A removable security device for portable articles comprising (a) an alarm housing including an audible alarm circuit, a locking mechanism, and a bottom surface;

(b) a receiver adapted to be attached to said portable article;

(c) a pair of opposed rails on said alarm housing bottom surface, said rails defining a channel approximately parallel to said bottom surface and having an ingress;

(d) a pair of opposed flanges on said receiver shaped to mate relatively snugly with said channel and to slide into said channel ingress;

(e) a stop means for preventing said flanges from sliding beyond effective engagement with said channel, said alarm housing being installed on said receiver when said flanges are slid into said channel and stopped by said stop means; and (f) a lock bolt selectively operated by said locking mechanism to extend from said alarm housing bottom surface into a shaped depression in said receiver when said alarm housing is installed on said receiver to secure said alarm housing to said receiver, and to retract from said shaped depression into said alarm housing bottom surface to permit removal of said alarm housing from said receiver.

2. The removable security device of claim 1 wherein each of said rails is a linear set of L-shaped protrusions.

3. The removable security device of claim 1 wherein said lock bolt is biased to extend out of said alarm housing.

4. The removable security device of claim 1 wherein said lock bolt extends from said alarm housing bottom surface between said rails.

5. The removable security device of claim 1 wherein said receiver is permanently attached to said portable article.

6. The removable security device of claim 1 wherein a removable attachment attaches said receiver to said portable article, said removable attachment being inaccessible when said alarm housing is installed on said receiver.

7. The removable security device of claim 1 wherein said alarm circuit includes a battery, said battery being stored in a battery compartment in said alarm housing, said compartment being covered by a hatch, said hatch being secured closed by a rod, said rod being operated by said locking mechanism to extend into an aperture in said hatch to secure said hatch closed and to retract from said aperture to allow removal of said hatch.

8. The removable security device of claim 1 wherein said alarm circuit includes a motion detector.

9. The removable security device of claim 1 wherein said alarm housing includes a retractable cable, said cable having a free end with a plug shaped to mate with a socket in said alarm housing.

10. A removable security device for portable articles comprising (a) a alarm housing including an audible electronic alarm circuit, a locking mechanism, a retractable cable having a free end with a plug shaped to mate with a socket in said alarm housing, and a bottom surface;

(b) a receiver adapted to be attached to said portable article;

(c) a pair of opposed linear sets of L-shaped protrusions on said alarm housing bottom surface, said L-shaped protrusions defining a channel approximately parallel to said bottom surface and having an ingress;

(d) a pair of opposed flanges on said receiver shaped to mate relatively snugly with said channel and to slide into said channel ingress;

(e) a stop means for preventing said flanges from sliding beyond effective engagement with said channel, said alarm housing being installed on said receiver when said flanges are slid into said channel and stopped by said stop means; and (f) a lock bolt selectively operated by said locking mechanism to extend from said alarm housing bottom surface into said channel and into a shaped depression in said receiver when said alarm housing is installed on said receiver to secure said alarm housing to said receiver, and to retract from said shaped depression into said alarm housing bottom surface to permit removal of said alarm housing from said receiver, said lock bolt being biased to extend out of said alarm housing.

11. The removable security device of claim 10 wherein said receiver is permanently attached to said portable article.

12. The removable security device of claim 10 wherein a removable attachment attaches said receiver to said portable article, said removable attachment being inaccessible when said alarm housing is installed on said receiver.

13. The removable security device of claim 10 wherein said alarm circuit includes a battery, said battery being stored in a battery compartment in said alarm housing, said compartment being covered by a hatch, said hatch being secured closed by a rod, said rod being operated by said locking mechanism to extend into an aperture in said hatch to secure said hatch closed and to retract from said aperture to allow removal of said hatch.

14. The removable security device of claim 10 wherein said alarm circuit includes a motion detector.

* * * * *